United States Patent [19]

Pinckard

[11] 4,277,006

[45] Jul. 7, 1981

[54] ROLLER SKATE CARRIER

[75] Inventor: William A. Pinckard, Woodland Hills, Calif.

[73] Assignee: Vicky England Pataick, Sepulveda, Calif. ; a part interest

[21] Appl. No.: 95,781

[22] Filed: Nov. 19, 1979

[51] Int. Cl.[3] ..... B65D 71/00

[52] U.S. Cl. ..... 294/145; 294/162; 294/166; 12/120.5

[58] Field of Search ..... 224/45 M, 45 S, 50, 224/45 P, 45 Q; 211/34, 37; 12/120.5

[56] References Cited

U.S. PATENT DOCUMENTS

| | | | |
|---|---|---|---|
| 2,883,688 | 4/1959 | Barreca | 224/45 S |
| 2,956,813 | 10/1960 | Madden | 224/45 S |
| 3,497,891 | 3/1970 | Vöster, et al. | 224/45 S |
| 3,718,242 | 2/1973 | Larson | 224/45 Q X |

*Primary Examiner*—Steven M. Pollard

*Attorney, Agent, or Firm*—Bruce L. Birchard

[57] ABSTRACT

By providing a novelly configured wheel-engaging stand portion adjustably spaced from a similarly configured, spring-biased wheel-engaging clamping portion, the combination being joined by a shaft having a handle at the extremity thereof remote from the stand portion, a roller skate carrier is provided that is self-standing, easy to load and unload and can accommodate any existing roller skate, including those with rear stops, toe stops or both.

10 Claims, 2 Drawing Figures

ROLLER SKATE CARRIER

BACKGROUND OF THE INVENTION

1. Field of the Invention

This invention relates to carriers for roller skates and, more particularly to such carriers which are self-standing and can accommodate a variety of roller skates.

2. Prior Art

Various types of carriers are available for carrying ice skates. However, they are not adaptable to carrying roller skates. At this time in history roller skating and roller skates are widely popular. Many people go from one roller skating site to another to join in the local fun, see new sights and meet new people. Carrying the skates can be a nuisance without some form of carrier. Skates come in a variety of sizes and with a variety of accoutrements. Some have toe stops and some have heel stops for braking the roller skates when in use. It is desirable that the carrier be able to accommodate the entire range of roller skates now available.

It is also desirable to be able to load and unload the skates from the carrier easily and to be able to set the carrier down without having it fall over, i.e. to have the carrier be a stand-alone device.

Therefore, it is an object of the present invention to provide a carrier for roller skates of a variety of possible sizes.

It is a further object of this invention to provide a roller-skate carrier which is self-standing, easy to load and unload and adaptable to a variety of skate sizes.

SUMMARY OF THE INVENTION

Stated succinctly, the present invention resides in providing a pair of novelly configured retaining blocks, (one of which is a base or stand) adjustably carried by a common rod at one end of which is a handle. The retaining block which is most proximate to the handle is movable along the rod over a portion of the rod, and is urged toward the other block by a spring or other biasing means to achieve clamping of skates inserted in the carrier. Appropriate recesses are provided in both blocks to accommodate the roller skate truck, wheels and stops. The spacing between the blocks is fixed-adjustable to accommodate various skate sizes.

BRIEF DESCRIPTION OF THE DRAWINGS

My invention, both as to its nature and operation, may best be understood by the description which follows taken in conjunction with the drawings herein, in which.

DETAILED DESCRIPTION OF THE PREFERRED EMBODIMENT

Figure 1:
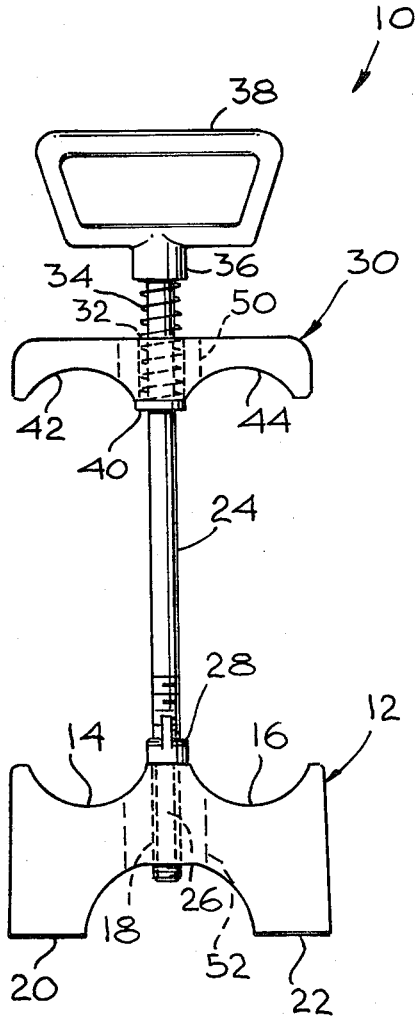
FIG. 1 is a front elevational view of one embodiment of my invention.
Figure 2:
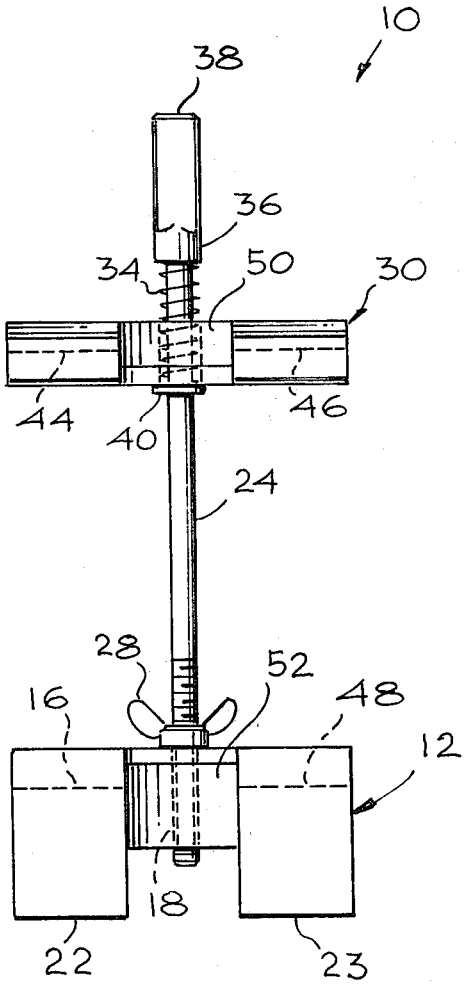
FIG. 2 is a side elevational view of the embodiment of FIG. 1.

In FIGS. 1 and 2, carrier 10 includes stand-block 12 having arcuate recesses 14 and 16 for receiving roller skate wheels. Block 12 has a centrally located, threaded opening 18 therethrough and feet 20, 22, 23 and an additional foot, not shown. Rod 24 has a threaded lower portion 26 which cooperates with threaded opening 18. Wing nut 28 serves to lock the rod 24 in position in lower block 12, setting the nominal spacing of stand-block 12 and upper or clamping block 30.

Upper block 30 is slidably supported on rod 24 by reason of opening 32 in block 30. The fit between rod 24 and opening 32 is loose to permit some tilting of clamping block 30 during loading and unloading roller skates from carrier 10. Rod 24 may be unthreaded in this region.

The clamping block 30 is urged towards stand-block 12 by spring 34 which abuts upper block 30 and shoulder 36 on handle portion 38. The movement of upper block 30 towards lower block 12 is restricted by stop 40, which may be a C-ring applied to rod 24 or a shoulder on rod 24.

Upper block 32 contains arcuate recesses 42, 44, 46 and an additional recess, not shown, to receive the four wheels (e.g., four rear wheels) of a pair of roller skates.

Lower block 12 has recesses 14, 16, 48 and one additional recess, not shown, for receiving the remaining four wheels (e.g., front wheels) of those skates. A space 50 (and a corresponding space, not shown, on the opposite side of rod 24) is provided to accommodate the rear stops or brakes found on modern roller skates. Additionally, a space 52 (and a corresponding slot or space, not shown, on the opposite side of rod 24) is provided in lower block 12 to accommodate the front stops or brakes found on many roller skates today.

To utilize the carrier 10, the front wheels of a roller skate are placed in the recesses in lower block 12 and the rear wheels are forced against upper block 30. Because of the resiliency of spring 34, block 30 is urged upward, allowing the rear wheels of the skate to move into the recesses in clamping block 30 which are opposite the recesses in lower block 12 into which the front wheels have been placed. Spring 34 urges upper block 30 towards lower block 12, retaining the roller skate therebetween.

In the event the separation between upper block 30 and lower block 12 is not in the proper range to accommodate the particular skate to be carried, wing nut 28 may be retracted on rod 24 to unlock the setting of rod 24 in lower block 12 and handle 38 may be turned to adjust the spacing of lower or stand-block 12 from upper block 30. Such adjustment is then set by returning nut 28 to a locking position against stand-block 12 and the skates are inserted. It is to be understood that the positions of the front and back wheels may be reversed in carrier 10, if desired.

Carrier 10 is free-standing by reason of the feet, such as feet 20, 22, 23 and an additional foot, not shown.

The spring constant of spring 34 is chosen to assure secure retention of skates inserted in carrier 10. Handle 38 permits easy transportation of carrier 10 and the skates therein to wherever the skater wishes to engage in his sport.

While a particular embodiment of my invention has been shown and described it should be apparent to one skilled in the art that variations and modifications therein may be made without departing from the spirit and scope of my invention.

I claim:

1. A carrier for roller skates, said carrier including:
   - a threaded rod having first and second extremities;
   - a stand portion carried on said rod towards said first extremity of said rod and including adjusting means for adjustably supporting said stand portion on said rod;
   - a clamping portion carried towards the second extremity of said rod in slidable relation to said rod;

a handle carried at said second extremity of said rod and including a shoulder portion engaging said rod;

a spring having first and second ends, said first end forcefully engaging said shoulder portion and said second end forcefully engaging said clamping portion and urging it towards said stand portion;

stop means carried by said rod and engaging said clamping portion for limiting the movement of said clamping portion in the direction of said stand portion;

said clamping portion including arcuate, wheel-receiving recesses therein;

said stand portion including arcuate, wheel receiving recesses therein positioned, during use of said carrier, opposite respective recesses in said clamping portion; and, feet carried by said stand portion and integral with said stand portion.

2. Apparatus according to claim 1 in which said clamping portion includes, in addition, recesses for receiving stop members on roller skates being carried.

3. Apparatus according to claim 1 in which said stand portion includes, in addition, recesses for receiving stop members on roller skates to be carried.

4. Apparatus according to claim 1 in which said spring is a coil spring surrounding said rod.

5. Apparatus according to claim 1 in which said rod is unthreaded in the region of its engagement with said clamping portion.

6. Apparatus according to claim 1 in which said adjusting means includes a threaded opening in said stand portion for receiving said threaded rod, and a locking nut carried by said rod.

7. Apparatus according to claim 1 in which said stop means is a "C"-ring carried by said rod.

8. Apparatus according to claim 1 in which said clamping portion and said stand portion each include additional recesses for receiving stop members on roller skates being carried.

9. Apparatus according to claim 1 in which said clamping portion and said stand portion include additional recesses for receiving stop members on roller skates being carried and said spring is a coil spring surrounding said rod.

10. Apparatus according to claim 1 in which said clamping portion and said stand portion each include additional recesses for receiving stop members on roller skates being carried, said spring is a coil spring surrounding said rod and said adjusting means includes a threaded opening in said stand portion for receiving said threaded rod, and a locking nut carried by said rod.

* * * * *